United States Patent [19]

Johnson et al.

[11] 3,932,909

[45] Jan. 20, 1976

[54] PERSONAL SELF-POWERED SCRUB BRUSH

[76] Inventors: George Beldon Johnson; Virginia M. Johnson, both of 218 N. 7th St., Avondale, Ariz. 85323

[22] Filed: Oct. 25, 1974

[21] Appl. No.: 517,954

[52] U.S. Cl. ..... 15/29; 185/39

[51] Int. Cl.[2] ..... A46B 13/06

[58] Field of Search ..... 15/23, 24, 26, 28, 29, 15/97 R; 185/37, 39, 40 H; 128/48, 56

[56] References Cited

UNITED STATES PATENTS

| | | | |
|---|---|---|---|
| 1,166,482 | 1/1916 | Reiche | 15/29 |
| 2,659,454 | 11/1953 | Bandli | 185/39 |
| 2,678,457 | 5/1954 | Demo et al. | 15/29 |
| 3,140,703 | 7/1964 | Barr | 185/39 X |

*Primary Examiner*—Edward L. Roberts
*Attorney, Agent, or Firm*—Marden S. Gordon

[57] ABSTRACT

A self-powered scrub brush intended for use by individuals in the cleansing of portions of their bodies, the scrub brush including a housing having a brush rotatively supported therein and projecting thereoutof, a hollow handle including a soap dispenser associated with the housing for dispensing soap thereinto, a valve for controlling the dispensing of the soap from the handle into the housing, a helical spring disposed between the brush and the housing in a manner to be wound and tightened upon rotation of the brush in a first direction with the spring then powering the rotation of the brush in the opposite direction, and a cord wrapped about the brush and extending outwardly of the housing for manual rotation of the brush in a direction to wind the spring. Holes are provided in the base of the brush for discharging the soap dispensed from the handle directly into the bristles of the brush for application to the skin of an individual for cleansing the same.

7 Claims, 7 Drawing Figures

PERSONAL SELF-POWERED SCRUB BRUSH

BACKGROUND OF THE INVENTION

1. Field of the Invention

This invention relates generally to hygienic accessories for individuals and more particularly to a novel and improved personal self-powered scrub brush intended for use by individuals in the scrubbing and cleansing of their bodies.

2. Description of the Prior Art

It has been known in the prior art to provide scrub brushes of various types and configurations for use by individuals in the scrubbing and cleansing of their bodies, such brushes including well known back brushes having long handles, foot brushes, and the like. All of these brushes are generally characterized by bristles of one type or another secured to a member having a handle for grasping in an individual's hand. This type of a brush suffers from the disadvantage, that an individual must scrub the same back and forth across the area to be cleansed to achieve a scrubbing action of the bristles on the individual's body.

While rotation of brushes is known to be available through use of battery powered or household current electrically driven motors, such are not truly functional for use around bath water as water entering into such mechanism causes the inoperativeness thereof when battery powered both due to the water effects on the battery powered motor as well as the effects of the water on the batteries themselves. As to the use of household current electrically powered devices in a bathtub, needless to say the danger thereof is so great that they are not recommended as any failure in the insulation thereof to permit water to enter thereinto may cause the electrocution of the individual using the same.

SUMMARY OF THE INVENTION

The present invention recognizes the increased scrubbing abilities of a rotating bristle brush, and upon recognizing the deficiencies and disadvantages of presently available personal scrub brushes, provides a novel solution thereto in the form of a self-powered scrub brush intended for use by individuals in the scrubbing and cleansing of their bodies in a safe manner requiring no source of electrical power which might endanger the life and well-being of the individual.

It is a feature of the present invention to provide a personal self-powered scrub brush.

A further feature of the present invention provides a personal self-powered scrub brush which is relatively simple in its construction and which therefore may be readily manufactured at a relatively low cost and by simple manufacturing methods so that it may be retailed at a sufficiently low price to encourage widespread use thereof.

Still a further feature of the present invention provides a personal self-powered scrub brush which is possessed of few mechanical parts and which therefore is unlikely to get out of order such that it may be guaranteed by the manufacturer to withstand many years of intended usage due to its rugged and durable construction.

Still a further feature of the present invention provides a personal self-powered scrub brush which is aesthetically pleasing and refined in appearance.

Yet still a further feature of the present invention provides a personal self-powered scrub brush which is easy to use and reliable and efficient in operation.

Still yet a further feature of the present invention provides a personal self-powered scrub brush having novel winding means for winding a self-contained spring which, in turn, drives the scrub brush in a direction about its axis upon the release of the winding means.

Other features and advantages of this invention will be apparent during the course of the following description.

BRIEF DESCRIPTION OF THE DRAWINGS

In the accompanying drawings forming a part of this Specification, and in which like reference characters are employed to designate like part throughout the same.

DESCRIPTION OF THE PREFERRED EMBODIMENT

Figures 1, 2, 3, 4:
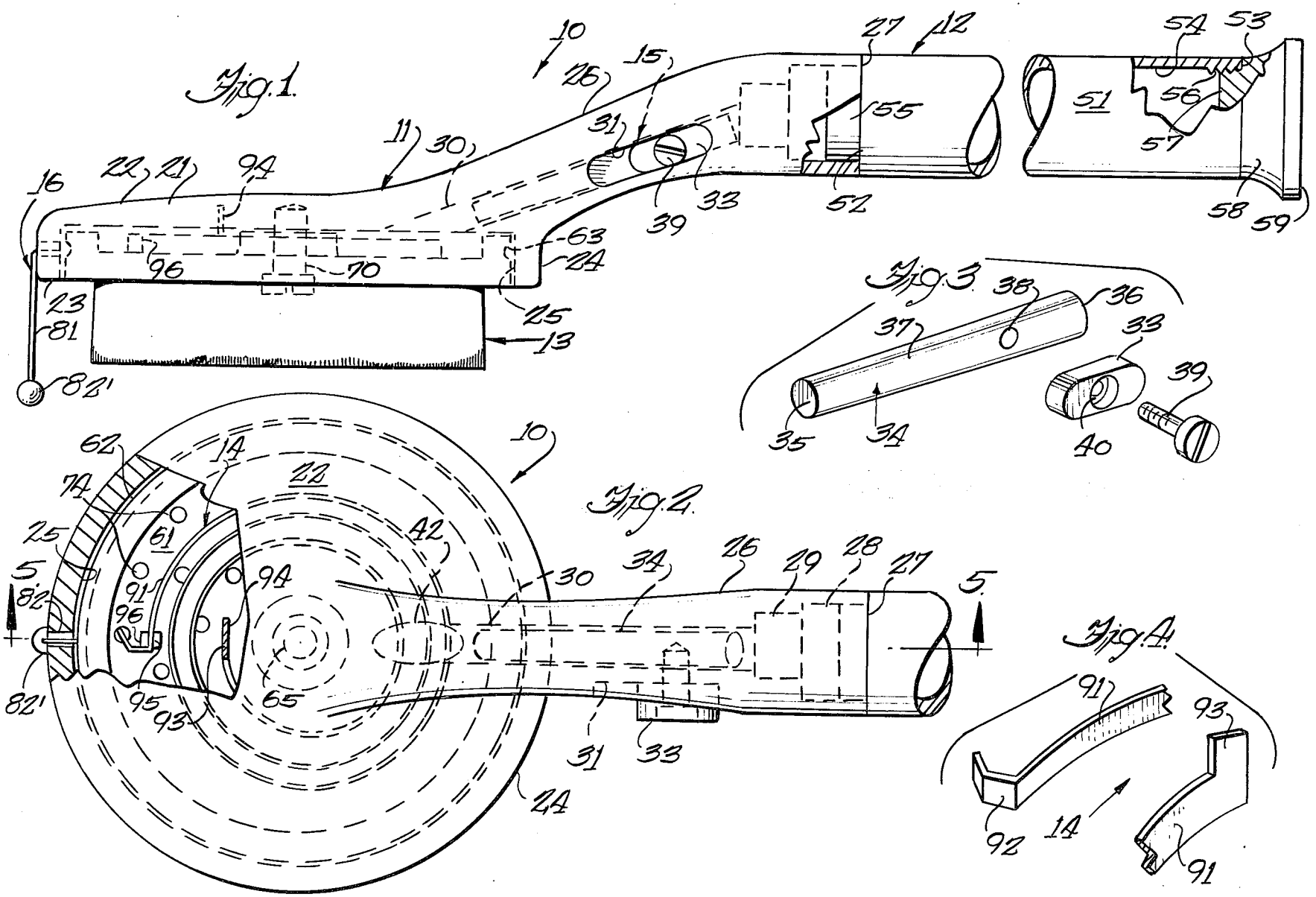
FIG. 1 is a front elevational view of the scrub brush of the invention.
FIG. 2 is a fragmentary top plan view of the scrub brush of the invention which is partially broken away to illustrate details of the spring therein.
FIG. 3 is an exploded perspective diagrammatic view of the piston valve portion of the scrub brush.
FIG. 4 is a fragmentary diagrammatic perspective view of the opposite ends of the spring illustrating the configuration thereof.

Referring now to the drawings in detail there is illustrated a preferred form of a personal self-powered scrub brush constructed in accordance with the principles of the present invention and which is designated generally in its entirety by the reference numeral 10 and which is comprised of a head member 11, a handle member 12, a circular brush 13, a spring 14, a valve assembly 15, and a winding cord 16.

The elements of the scrub brush 10 may be manufactured out of any suitable satisfactory material providing an aesthetically pleasing and refined appearance, with the preferred embodiment having the housing 11, handle 12, and valve 15 manufactured of a suitable plastic material which may be provided in a variety of colors appealing to prospective purchasers, just as the brush 13 may have bristles provided in a variety of complementary colors providing an aesthetically pleasing appearance.

The head member 11 consists of a flat circular housing 21 having a top surface 22 and a bottom surface 23 with cylindrically surrounding side walls 24. A brush receiving circular compartment 25 is defined interiorly of the housing 21 opens out of the bottom surface 23 centrally thereof. Formed integrally with the housing 21 is a valve containing housing portion 26 which extends upwardly and outwardly from the top surface 22 at an angle thereto and terminates at outer end 27. A bore 28 is disposed centrally of outer end 27 and opens inwardly thereof and is of a circular cross-sectional area, the bore 28 terminating inwardly thereof at a bore 29 disposed concentrically therewith and of a circular diameter which is less than the diameter of bore 28. The innermost end of bore 29 terminates in one end of a conical passageway 30 which extends through the portion 26 and terminates in communication with the brush compartment 25 in a position inwardly of the peripheral edges thereof.

Figure 5:
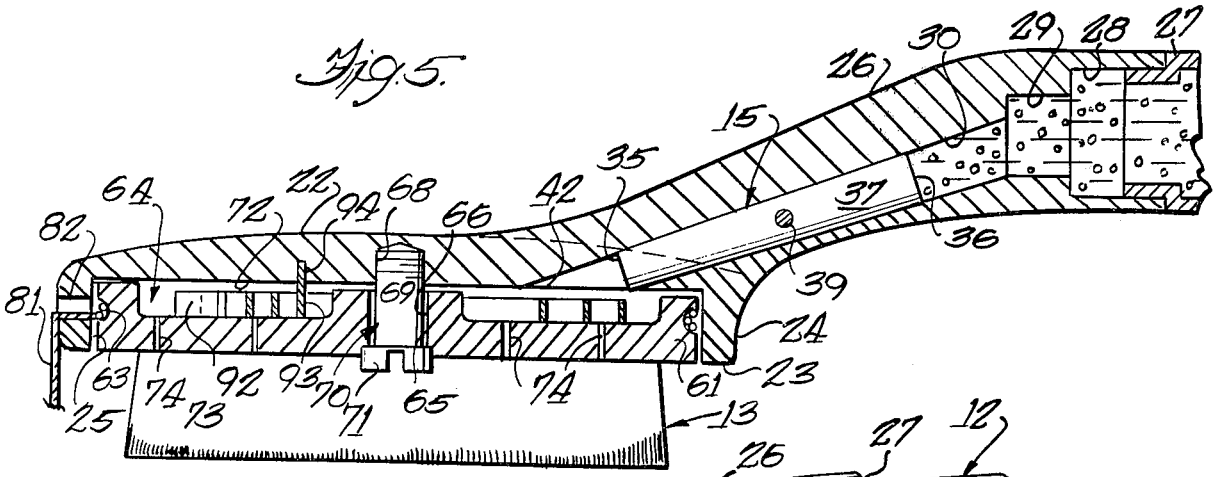
FIG. 5 is a cross-sectional view taken along Line 5—5 of FIG. 2.
Figure 5:
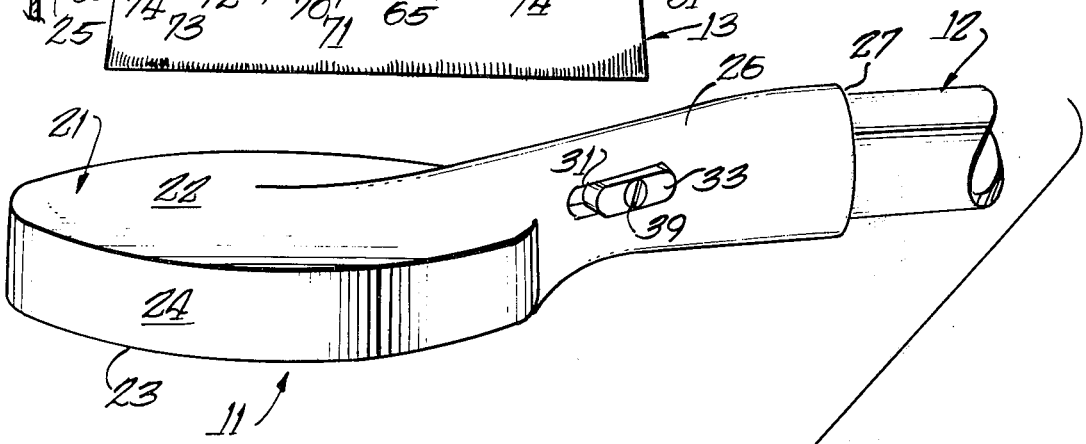
Figure 6:
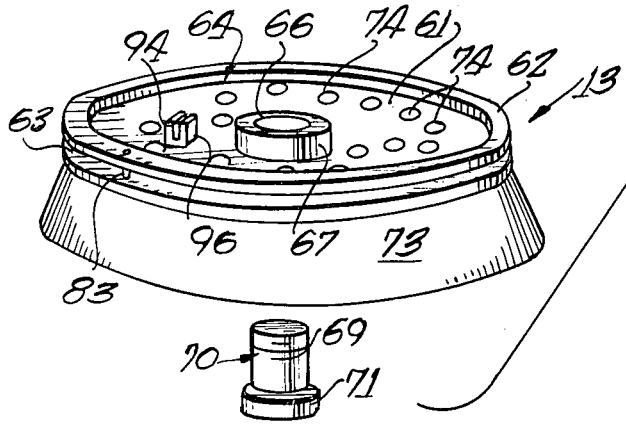
FIG. 6 is an exploded perspective view of the head portion of the scrub brush.
Figure 7:
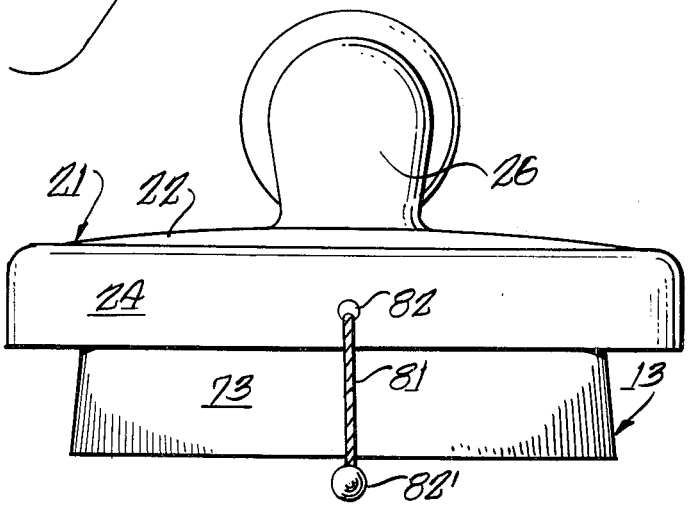
FIG. 7 is a front end elevational view of the scrub brush.

Disposed longitudinally through a side wall surface of the portion 26 is a slot 31 in communication with passageway 30. A rectangularly elongated knob 33 of a length less than the length of slot 31 and a width substantially filling the width of slot 31 is disposed slidably in slot 31 for guided slided movement longitudinally therealong. A piston 34 is disposed in passageway 30 and is of a truncated conical configuration having truncated apex portion 35, base 36, and conical side walls 37. The base 36 is of a lesser diameter than the end of passageway 30 adjacent bore 29 while being of a greater diameter than the opposite end of passageway 30. Similarly, the apex 35 is of a greater diameter than the opposite end of the passageway 30 while being of a lesser diameter than base 36. Thus, as seen in FIG. 5, movement of piston 34 longitudinally of passageway 30 in the direction of head member 11 engages the sides 37 of the piston with the sides of the passageway to close the same, while moving the piston in the opposite direction frees the piston side from the passageway to open the passageway. A threaded aperture 38 is provided in a side wall 37 of the piston 34 and is adapted to receive therein the shank of a screw 39 which passes through an aperture 40 in knob 33 so as to retain the knob 33 to the piston 34 to effect sliding operation of the piston in passageway 30 from a position exteriorly of the portion 26.

The piston 34 is operable by knob 33 to slide longitudinally of passageway 30 between a first position opening the passageway for passage therethrough of liquid from bore 28 through bore 29 and passageway 30 and into the brush compartment 25, the piston being slidable in the passageway to effect therewith a closing of the port 42 in the top of brush compartment 25 to thus close the passageway and prevent passage of liquid therethrough into the brush compartment.

The handle 12 is of an elongated cylindrical hollow configuration having cylindrical side walls 51, an open front end 52, an open back end 53, a cylindrically shaped hollow compartment 54 extending completely therethrough, and a reduced diameter front segment 55 extending forwardly of front end 52 and formed integrally therewith and having an exterior diameter equal to the interior diameter of bore 28 so as to be tightly and snugly received therein with end 27 of portion 26 abutting against front end 52 in a sealing manner. Suitable adhesives may be applied to the abutting portions of the handle member and portion 26 to permanently retain the same connected thereto.

The interior surface of compartment 54 adjacent back end 53 is provided with screw threads 56 which are adapted to threadedly receive therein the threaded inner end portion 57 of a cap or stopper 58 having a top end 59. The cap is threadedly received on the handle member 12 in a removable manner for ease of access to compartment 54, this allowing an individual to place any desired liquid soap substance in compartment 54 so that it may be eventually discharged through passageway 30 into the brush compartment 25 as will be later described.

The brush 13 is of a circular configuration having a flat circular disc shaped base 61 with a flat top and bottom surface and having disposed about its periphery a collar member 62 provided with an annular peripheral groove 63 extending completely thereabout. Collar 62 juts upwardly above the top surface of base 61 to completely surround the same and form a circular diameter chamber 64 therein. An opening 65 extends through the axis of base 61 and is axially aligned with opening 66 disposed centrally of cylindrical boss 67 mounted to the top surface of base 61 and projecting vertically upwardly therefrom, the boss 67 extending vertically upwardly a distance equal to the vertical projection of the collar 62 above the top surface of base 61.

A threaded cylindrical aperture or recess 68 provided centrally of brush compartment 25 in the top surface thereof and opening thereoutof and is adapted to threadedly receive therein the threaded shank 69 of bolt 70 having an enlarged flat circular head portion 71 for rotatively affixing brush 13 in brush compartment 25 with the topmost edges of the collar 62 and cylindrical boss 67 disposed in close juxtaposition with the compartment top surface 72.

A multiplicity of bristles 73 each having one end affixed in any suitable manner to the bottom surface of base 61 with the bristles depending outwardly and downwardly therefrom to provide a bristle scrubbing area for the brush 13.

A plurality of spaced apart openings 74 are provided in base 61 and extend completely therethrough between the chamber 64 and the bottom surface of the base for discharging into the bristles any liquid soap substance disposed in chamber 64*m* such as that disposed thereinto through the passageway 30.

For effecting manual rotation of the brush 13 about its axis there is provided the winding means 16 consisting of an elongated flexible cord 81 having a spherical knob 82' secured to a projecting free end thereof and with the cord extending through an opening 82 provided in the front end of a side wall 24 of the housing 21, the cord thence being wrapped about the annular groove 63 in the base member 61 and having its opposite end thereof permanently affixed to the base member by means of a pin 83 extending vertically through the groove and affixed permanently therein between the flanges of the collar member 62. Rotation of the brush member 13 about its axis effects the winding of the cord 81 about the groove 63 until spherical knob 82 engages the outer peripheral surface of opening 82.

The spring 14 is of a spiral helical configuration having a flexible body member 91 with opposed front and back ends 92 and 93 respectively. And 92 is of a general U-shaped configuration where the end portion thereof overlaps a portion of the body member 91. And 93 is of a general L-shaped configuration wherein the terminal end projects vertically upwardly above the top edge of the body member 91.

For use with the spring 14 there is provided in the top surface 72 of brush compartment 25 a rectangular recess 94 spaced radially outwardly from opening 68 a distance greater than the radius of the cylindrical boss member 67, the recess 94 adapted to permanently receive therein the back end 93 of the spring 14 wherein the projecting end of the back end is tightly fitted thereinto such that the body 91 of the spring is coiled about the chamber 34 in a helical manner with the front end 92 of the spring being received in a slot 95 extending through a U-shaped flange member 96 having its bight portion permanently secured to the top surface of the base member 61 and spaced radially outwardly from the axis of the base member.

The cord 81 is wrapped about groove 63 in a direction opposite to the direction of winding of the spring 14 in chamber 64 such that pulling of the cord 81 outwardly of the housing 21 through opening 82 effects the winding of the spring 14, with release of the cord 81 permitting the spring 14 to power drive the rotation of brush 13 about its axis to achieve the self-powered scrubbing action of the brush.

In operation, an individual places liquid soap in handle compartment 54 with the valve 15 in the closed position. When ready for use, the individual opens the valve 15 by means of the piston 37 to permit soap to be discharged from the compartment 54 through the interconnected bores 28 and 29, passageway 30 and into the brush compartment 25 where it is received in the brush chamber 64. From there the liquid soap finds its way through the opening 74 into the bristles 73 such that soap is directly applied to the bristles and not to the skin of an individual using the brush 10. Release of the cord 81 after it has been used to wind the spring 14 by rotation of the brush 13 permits the spring to drive the brush rotatively about its axis such that a powered scrubbing action is achieved on the skin of the individual as well as the soap being dispensed directly onto the bristles and onto the individual's skin for an improved hygienic cleaning of the body of the individual.

It is to be understood that the form of this invention herewith shown and described is to be taken as a preferred example of the same, and that this invention is not to be limited to the exact arrangement of parts shown in the accompanying drawings or described in this Specification as various changes in the details of construction as to shape, size and arrangement of parts may be resorted to without departing from the spirit of the invention, the scope of the novel concepts thereof, or the scope of the sub-joined claims.

Having thus described the invention, what is claimed is:

1. A personal self-powered scrub brush intended for use by individuals for scrubbing and cleansing of their bodies, the scrub brush comprising, in combination:

a head member;

a handle member;

a liquid soap containing compartment defined in said handle member;

means interconnecting said handle member to said head member for dispensing liquid soap from said soap containing compartment into said head member;

a valve interposed between said handle member and said head member for controlling the flow of said liquid soap therebetween;

a circular brush rotatively affixed to said head member and projecting outwardly therefrom and adapted to receive soap from said head member;

spring means disposed intermediate said brush and said head member and having one end connected to said brush and the opposite end connected to said head member for effecting winding of the spring by rotation of said brush in a first direction, with said wound spring effecting rotation of said brush in the opposite direction during unwinding of said spring; and a flexible cord wrapped about said brush and extending outwardly of said head member and adapted for use in the rotation of said brush in a direction to wind said spring means with said cord being automatically rewound about said brush as said spring means unwinds and rotatively drives said brush.

2. A scrubbing brush as set forth in claim 1 wherein said head member comprises:

a housing of a generally flat circular configuration having a top surface, a bottom surface, and depending cylindrical side wall surface forming a brush receiving compartment of a circular diameter formed integrally in said housing member substantially centrally thereof and opening out of said bottom surface, an opening adapted to receive said flexible cord therethrough, said opening extending through said housing member side wall surfaces normal to the axis of said brush compartment and interconnecting exterior of said housing member to the interior of said brush receiving compartment;

a threaded cylindrical recess formed integrally in said housing member concentric with the axis of said brush receiving compartment and opening out of said brush receiving compartment top surface; and means engaging said threaded cylindrical recess to rotatively support said brush thereon.

3. A scrubbing brush as set forth in claim 2 wherein said valve means and said means interconnecting said handle member to said head member comprises:

an elongated generally cylindrically shaped body member formed integrally with said handle member housing portion and extending radially outwardly and upwardly therefrom and terminating at a back end spaced outwardly from said handle member housing portion;

a bore of a circular diameter formed integrally in said outermost end of said body member and opening outwardly therefrom;

an elongated passageway extending from said bore through said body member and into said head member housing where it opens into said brush receiving compartment through the top surface thereof;

a slot formed integrally in a side wall of said body member extending parallel to said passageway and placing said passageway in communication with exterior of said body member;

a knob of a width to be guided by opposite edges of said slot and of a length less than said slot being slidably received in said slot for longitudinal movement therealong between opposite ends of said slot;

a truncated conically shaped piston member having a truncated forward apex end, a base end, and conical side walls, the piston slidably received in said passageway between a position opening said passageway and a position closing said passageway;

a threaded aperture disposed in a sidewall of the piston adjacent said slot; and a threaded bolt adapted to pass through an aperture in said knob and be threadedly received in said threaded aperture of said piston for attaching said knob to said piston for controlling the movement of said piston by said knob exteriorly of said body member between said open and said closed positions.

4. A scrubbing brush as set forth in claim 3 wherein said handle member comprises:

an elongated hollow cylindrical body member having an open front end, an open back end, cylindrical side walls, and a cylindrical compartment extending completely therethrough;

a reduced diameter flange member formed integrally with said front end and projecting axially outwardly therefrom and having an exterior diameter substantially equal to the interior diameter of said body member bore and adapted to be telescopically received in said bore with said front end of said handle member in abutting relationship with said back end of said handle member;

screw threads disposed about the interior side walls of said compartment adjacent said back end thereof; and a cap having a body portion with screw threads disposed about the periphery thereof and adapted to be threadedly received on said threaded portion of said compartment to sealingly close said compartment while permitting access thereto for the insertion of liquid soap thereinto.

5. A scrubbing brush as set forth in claim 4 wherein said brush member comprises:

a flat disc shaped base member having a flat top surface and a flat bottom surface;

a cylindrical collar member affixed to the periphery of said base member and projecting upwardly from the top surface thereof to define with said top surface a brush chamber;

an aperture extending through the axis of said base member;

a cylindrical boss member formed integrally with said top surface of said base member concentric with said aperture and extending upwardly therefrom a distance equal to the distance of projection of said collar member and having an aperture extending therethrough in alignment with said base member aperture;

an annular groove disposed about said collar member and adapted to receive said cord therein, said groove disposed in registration with said side wall opening of said housing member when said brush is received in said brush compartment;

a pin extending through said annular groove for having one end of said cord affixed thereto;

a multiplicity of flexible brush forming bristles each having one end affixed to the bottom surface of said base member with said bristles projecting downwardly and outwardly therefrom;

a multiplicity of openings disposed completely about said base member in said brush chamber and extending through said base member to place said top surface of said base member in communication with said bristles; and said collar member being of a diameter less than the diameter of said housing member brush receiving compartment so as to be received concentrically therein for rotation relative thereto.

6. A scrubbing brush as set forth in claim 5 wherein said means rotatively mounting said brush member in said housing member comprises an elongated bolt having a threaded shank and an enlarged head portion, the shank being of a diameter to be received through said axially extending aperture of said brush base member and to be threadedly received in said threaded recess of said housing member, said bolt head member being of a diameter larger than said apertures to engage said base member bottom surface to rotatively support said brush member in said brush receiving compartment.

7. A scrubbing brush as set forth in claim 6 wherein said spring means comprises:

a flexible body member disposed in a spiral configuration and having a front end and a back end;

said front end being of a general U-shape configuration wherein said end overlaps a portion of said body member and lies co-planar therewith;

said back end being of a general L-shaped configuration and projecting above a top edge of said body member;

a rectangular formed integrally in said top surface of said brush receiving compartment and spaced radially outwardly from said threaded aperture a distance greater than the radius of said base member cylindrical member, said recess adapted to receive therein said back end of said body member with said body member of said spring lying in a spiral configuration in said brush chamber intermediate said collar member and said cylindrical member; and a U-shaped yoke member having its bight portion affixed to said base member top surface with its legs projecting upwardly therefrom and defining therebetween a circumferally oriented slot adapted to receive therein said U-shaped front end of said spring body member;

whereby rotation of said brush member relative to said housing member in the direction of winding of said spring member will effect the winding of said spring member, and upon release of said brush member said wound spring member will effect rotation of said brush member in an opposite direction on winding said spring member.

* * * * *